US006244995B1

(12) United States Patent
Prsala

(10) Patent No.: US 6,244,995 B1
(45) Date of Patent: Jun. 12, 2001

(54) FITNESS EXERCISE APPARATUS—THE SLIDER

(75) Inventor: Jan Prsala, 259 Five Island Road, Hubley, Nova Scotia (CA), B3Z 1B5

(73) Assignee: Jan Prsala, Hubley (CA)

( * ) Notice: Subject to any disclaimer, the term of this patent is extended or adjusted under 35 U.S.C. 154(b) by 0 days.

(21) Appl. No.: 09/323,926

(22) Filed: Jun. 2, 1999

(51) Int. Cl.[7] ..... A63B 21/068

(52) U.S. Cl. ..... 482/96; 482/72; 482/101; 602/32; 602/35

(58) Field of Search ..... 482/72, 96, 95, 482/101, 142, 121; 602/32–40

(56) References Cited

U.S. PATENT DOCUMENTS

| | | | | |
|---|---|---|---|---|
| 1,979,716 | * | 11/1934 | Terry . | |
| 3,658,327 | * | 4/1972 | Thiede | 482/96 |
| 4,176,836 | * | 12/1979 | Coyle | 272/120 |
| 4,272,074 | * | 6/1981 | Sferle | 482/96 |
| 4,911,438 | * | 3/1990 | Van Straaten | 272/138 |
| 5,169,363 | * | 12/1992 | Campanaro et al. | 482/96 |
| 5,263,913 | * | 11/1993 | Boren | 482/96 |
| 5,445,583 | * | 8/1995 | Habing | 482/52 |
| 5,810,698 | * | 9/1998 | Hullett et al. | 482/96 |

* cited by examiner

*Primary Examiner*—Jerome W. Donnelly
*Assistant Examiner*—Lori Baker Amerson

(57) ABSTRACT

The invention relates to an exercise device capable of entirely supporting a person's head, back and buttocks (seat) through the use of a carriage (located and moving on the inclined semi-circular tracks) and the feet through the use of the foot rest. The semi-circular tracks and the foot rest are mounted on vertical posts which are connected to a solid rectangular frame. The movement of the carriage is made possible by four small wheels fastened at the bottom of the carriage, which roll in corresponding partially covered grooves of the semi-circular tracks.

The body weight of a person is used as a resistance for the exercises which can be varied by changing the inclination of the tracks.

When a person is properly positioned in the device, the person's body moves the carriage up the tracks by the interaction between the torso and the legs. The flexed legs extend and the head and back resist the leg action by pressing against the carriage. On the way down, the legs (by flexing) control and stop the movement of the body and carriage. Thus a beneficial exercise for the legs, buttocks, pelvis, lower back, upper back and neck is generated. This exercise may improve the person's body posture.

The device is further equipped with two pairs of firm handles on both front and rear posts, with another set of handles, cables and pulleys on the back end of the tracks and with similar pair of handles on the sides of the carriage. All these handles serve for the various arm exercises executed with or without the assistance of the rest of the body.

9 Claims, 3 Drawing Sheets

FITNESS EXERCISE APPARATUS— THE SLIDER

CROSS-REFERENCE TO RELATED APPLICATIONS

"Not Applicable"

STATEMENT REGARDING FEDERALLY SPONSORED RESEARCH OR DEVELOPMENT

"Not Applicable"

REFERENCE TO A MICROFICHE APPENDIX

"Not Applicable"

BACKGROUND OF THE INVENTION

The invention relates to an exercise device, in particular to an exercise device suitable for the development of general physical fitness and for the improvement of body posture.

DESCRIPTION OF PRIOR ART

U.S. Pat. Nos. 5,263,913, 5,810,698 and 5,445,583 teach that these devices also consist of inclined tracks, carriage and footrest. However, the tracks and the carriage are straight and the devices are designed for completely different exercises.

U.S. Pat. No. 4,176,836 is the only device which bears some similarity to our proposed device. It takes advantage of a discretely curved incline or tracks on which the carriage can be moved up and down by the exercising person. It has also a footrest.

What makes this device entirely unsuitable for the exercises our device offers is as follows:

- the curve of the tracks is of a much larger radius compared to our tracks and the inclination of the tracks cannot be changed;
- the carriage is not curved and parallel to the tracks. It is placed on the tracks at a large angle (the bottom part of the carriage is quite a distance from the tracks, while the top part sits by the small wheels directly on the tracks).

Consequently, the carriage moves up the tracks by extension of the legs and the pressing of the shoulders against the shoulder pads of the chair. This exercise compresses the spine instead of bending it and the shoulders are exposed to enormous stress. The sole purpose of the device according to the author is "to vary the resistance encountered by the body part or parts along a discreetly curved incline, whereby the resistance varies automatically and instantaneously commensurate with the sine of the angle of the incline".

Our device serves a completely different purpose. The tracks and carriage are more curved and the carriage moves parallel to the tracks. The carriage is propelled by the interaction between the legs and torso (including the head) of a person. The legs apply the force relative to the carriage and the body at approximately 60 degrees angle (not along the longitudinal axis of the back which is the case in compared device). This in turn permits the person to resist this force by the whole length of the trunk and also by the head. The carriage then moves upward and backward as a result of the friction between the person's back, head and the surface of the carriage. Hence, the curved carriage. Our inclined tracks are curved at a specific radius in order to permit a person to fully extend the legs while maintaining almost the same angle of force application relative to the carriage and person's back. This is very important for flexing the lumbar spine and for stretching and strengthening the lower back muscles. The upper back and neck muscles are also strengthened due to this crucial detail in the construction of our device.

The listed patents involve devices which are designed for a different purpose. The difference from our device renders them inapplicable for the exercises our device can provide.

Various exercise devices have been proposed, however, they generally require that the user be either standing, sitting or lying to perform the exercise. Such devices are not satisfactory for some people with lower back pain, since the very position in which the exercise is performed, such as sitting or standing, may well aggravate the condition. Such devices may correctly develop muscles of the arms and legs, however, they may incorrectly shorten the lower back muscles which may lead to a faulty body posture and back pain. Many devices have been developed for strengthening the abdominal muscles and very few for correct and sufficient development of the back muscles.

Accordingly it is the object of the instant invention to overcome these difficulties in previous devices by providing a device that allows the person's body to assume a supine flexed position with rounded (flexed) lower back (lumbar spine) and to maintain or even increase this flexed lumbar spine during the exercise. Thus lower back muscles are not only beneficially stretched but also strengthened in their elongated state. This is the key factor for improving person's body posture.

In recent years, more attention has been paid to the improvement of physical fitness as well as to the problem of lower back pain caused by an incorrect body posture. The instant invention seeks to provide an exercise device which would develop physical fitness and maintain or improve body posture. Such a device would be suitable not only for a healthy person but also for a person suffering from back pain or other related conditions. Such a device would also be suitable for increase or maintenance of physical fitness in people of advanced years.

BRIEF SUMMARY OF THE INVENTION

The instant invention offers a substantial improvement over the prior art as more fully described hereinafter.

There is provided an exercise device capable of entirely supporting a person by the trunk and feet of the person consisting of a trunk support or carriage and footrest. The carriage equipped with four small wheels moves relative to the footrest in the grooves of the inclined semi-circular tracks, while the footrest is stationary. Due to the gravitational force, the carriage is normally positioned at the bottom end of the tracks at the beginning of the exercise. The person lies on the carriage on the back (in a supine position) with the whole length of the body except for the legs which are flexed in hips, knees and ankles and rest with the feet on the footrest. Due to the 40 degree inclination of the front part of the carriage, the pelvis of a person is flexed forward. The exercise consists of partial or full extension and flexion of the legs. The nature of this exercise (body position and angle of the force application) allows to maintain or even increase the flexion of the pelvis during the exercise. The trunk with the carriage slide in an arcuate movement backward and upward on the slanted semi-circular tracks due to leg extension and then they slide following the same path forward and downward due to the gravitational force under the control of the flexing legs. When the legs are straightened against the resistance of the body and carriage and then flexed in order to slow down the body's fall, beneficial exercise may be achieved for the legs, buttocks, back and neck. The leg extension can also be assisted by arm flexion and extension or the body with the carriage can be raised and lowered with the arms exclusively. Thus various muscles of the arms, trunk, shoulders and hands can be developed. In all these exercises, the involved muscles are exposed to both concentric and eccentric contractions.

In the instant invention the user can move the body and the carriage with arms by gripping special firm handles with the hands. These handles are located on both the front and rear upright posts. The body moves backward by arm flexion and is slowed down on the way forward by arm extension when using the handles on the rear posts. The body moves backward by arm extension and forward by arm flexion when using the handles on the front posts. In the first case the user primarily develops the biceps and in the second case the triceps.

The instant invention allows a method of exercising wherein a person fully supported by the carriage located on the inclined semi-circular tracks and by the feet positioned on the footrest moves the body alternatively backward against the gravitational force by leg extension and/or arm flexion and forward with the gravity by leg flexion and/or arm extension. None of the prior art allows the body to exercise by moving it along the semi-circular tracks with fixed feet on the footrest and thus keeping the pelvis in a flexed position. In the instant invention, the carriage connected with the inclined semi-circular tracks by means of the small wheels moves during the exercise following an arcuate path away from the stationary footrest by person's leg extension and/or arm flexion and then moves back on the same semi-circular path towards the footrest by leg flexion and/or arm extension.

In the instant invention two other pairs of handles connected to cables and pulleys enable the user to execute various arm, shoulder, chest, trunk and hand actions with wide range of movement while sliding the body with the carriage back and forth.

One pair of handles (free handles) is located by the rear end of the tracks along with pulleys (which can swivel laterally) and corresponding cables connect the handles over the pulleys with the rear end of the carriage, where they are attached. The carriage in its forward movement is stopped at the bottom by the front end of the grooves on the semi-circular tracks and by the given length of the cables, when the handles are resting on the firm handles located on the rear upright posts.

Second pair of handles (so called bench press handles) is located with the pulleys on the sides of the carriage about in mid-distance of the length of the carriage. The cables extend from the handles over the pulleys to the rear upright posts, where they are attached. These handles, cables and pulley mechanism (system) enables the user to execute the arm exercise reminiscent of the bench press. Partial or full arm extension and flexion moves the body with the carriage back and forth and provides the user with beneficial arm, shoulder, chest and back exercise.

In the instant invention, the semi-circular tracks are suspended between the rear and front upright posts. The front end of the tracks is hinged to the bottom part of the front upright posts. The rear end of the tracks can be raised or lowered and anchored in a desired position by placing it on the supporting bar of the carriage which spans between the rear upright posts and can be attached by pins to the posts at various heights. The required resistance in various exercises can be modified by changing the inclination or the angle of the tracks.

In the instant invention the user can perform additional arm exercises by placing the hands on the front or rear upright posts and move the body with the carriage back and forth by arm flexion and extension or vice versa. In the instant invention the user can also perform a variety of exercises in different body positions such as lying on the back, lying on the stomach, sitting, kneeling, and finally squatting or standing. In each case, the user can face forward or backward relative to the device. While kneeling, he can also face sideways.

In these various exercises the horizontal position of the tracks is mainly being used and the body with the carriage are propelled by the pushing or pulling action of the arms and/or legs (flexion, extension) while the hands and/or feet are placed or hooked on different handles, front or rear upright posts, front or rear footrest of the semi-circular tracks, or on different footrest. None of the previous art allows such a variety of exercises in so many body positions.

In the instant invention three different footrests are mounted at different levels and distances relative to the carriage on the front upright posts. Each of the footrests enables the user to execute different leg extension and flexion with varied intensity, range of movement and the angle of force application relative to the body.

The footrests can serve two functions. Placement of the soles of the feet on the footrest allows the user to push against the footrest and move the body with the carriage backward by leg extension. By hooking the feet behind the footrest either by the heels or by the top surface of the feet the user can pull upon the footrest and so pull the body with the carriage forward. The second pulling type of leg action can be also used in a form of resistive exercise where the leg action is counteracting the arm action. The semi-circular tracks can be either in an inclined or horizontal position. For more comfort, the footrests can be padded from the front or provided with two horse shoe like straps or cuffs for anchoring the feet at the ankles.

Similar leg action can be applied when the semi-circular tracks are in a horizontal position. In this case the carriage is located at the lowest point at the center of the semi-circular tracks and can be moved forward and upward either by pulling it with the body by leg flexion or pushing it by arm extension with hands placed on the firm handles of the rear upright posts or directly on these posts. The carriage is pulled backward and upward by arm flexion or leg extension. The user can similarly pull the carriage forward and upward by a pulling arm action with hands placed on the handles of the front upright posts or directly on these posts. Beneficial and interesting exercises are achieved by such a varying cooperation of the legs and arms. None of the previous art allows these types of exercises.

In the instant invention the semi-circular tracks can be made out of round instead of rectangular bars. In that case they would not have grooves and the carriage would be equipped with rollers (instead of the wheels). The width and depth of the outside grooves on the rollers would correspond to the diameter of the round metal bars or pipes of the tracks. The carriage would then move on the tracks with the assistance of the rollers. In order to prevent derailment of the carriage, the carriage would have four pairs of rollers, one of the pair running on the top and the other at the bottom of the tracks. Each pair of rollers would be interconnected with two metal brackets at a distance given by the diameter of the metal bars and attached to the bottom of the carriage.

In the instant invention the semi-circular tracks can be made from plastic or fiberglass material in a form of a solid semi-circular ramp with two grooves corresponding to the wheels of the carriage.

In the instant invention a strain gadget can be attached to the footrest in order to measure the pressure (force) applied by the feet during the exercise.

The instant invention can also be equipped with a counter of the repetitions of the exercise, a timing device recording the time elapsed of performed exercise, an alarm clock, a heart-rate monitor and heart-rate controls. The record of these six devices can be displayed for observation on a panel conveniently located on the front upright posts.

DETAILED DESCRIPTION OF THE INVENTION

Figure 1:
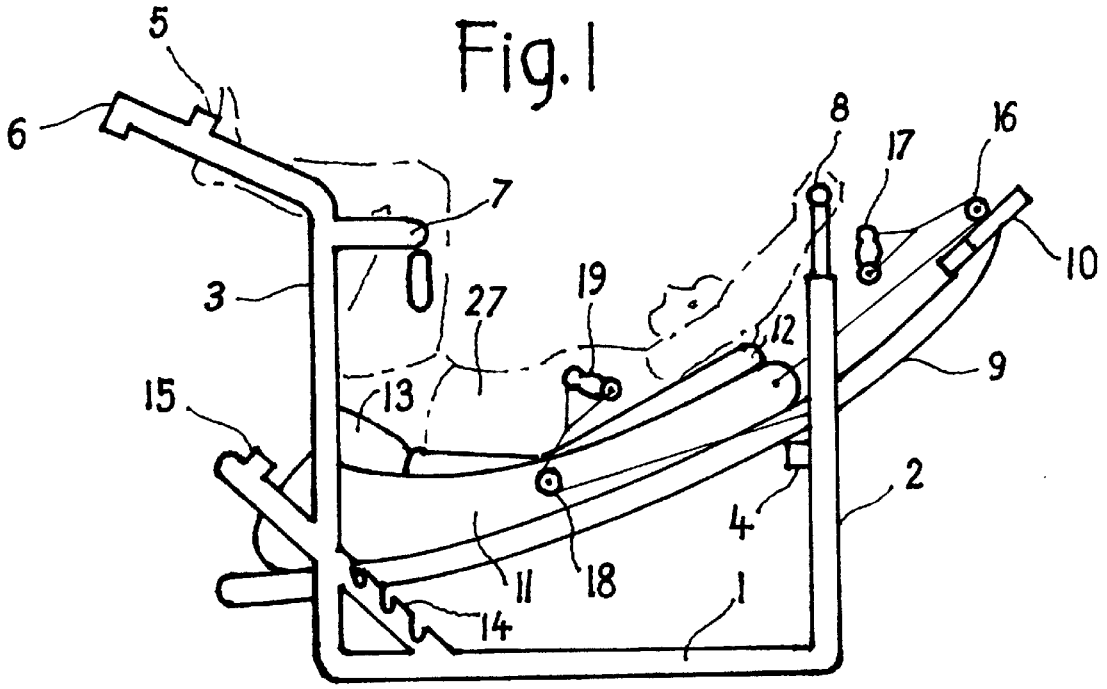
FIG. 1 is a side view of the assembled apparatus indicating its prescribed method of use with a person in the initial position and the carriage down or forward.
Figure 2:
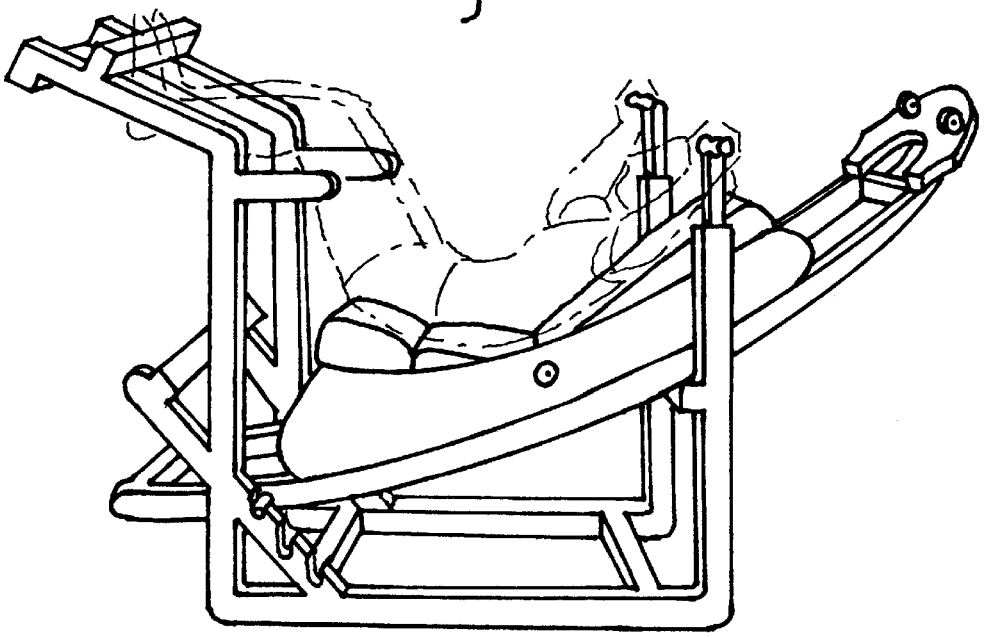
FIG. 2 is a side perspective view of the assembled apparatus with a person in action and with the carriage partially up the semi-circular tracks or backward.
Figure 3:
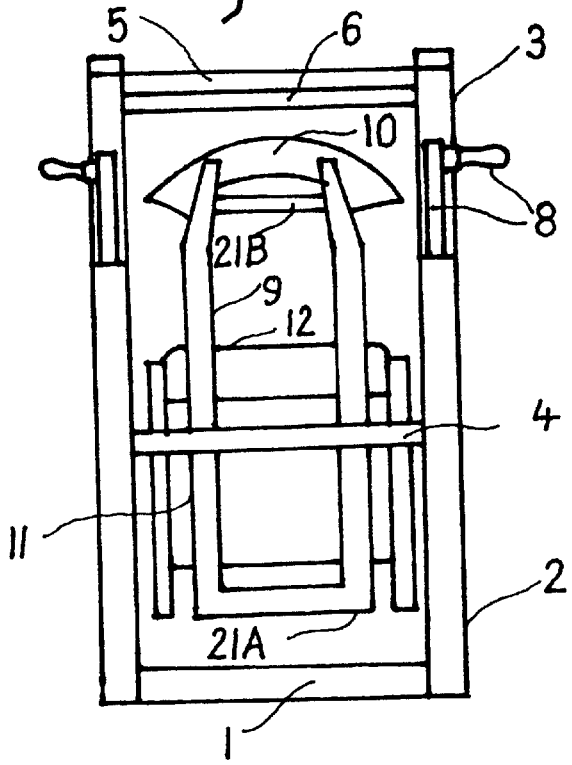
FIG. 3 is a rear view of the assembled apparatus.

As shown in the drawings, the apparatus consists of four main component parts being a sturdy rectangular base (frame) 1, an upright suspension means consisting of four rigid vertical posts 2,3, semi-circular tracks 9 and a carriage (trolley) 11.

The posts 2,3 are mounted on the common rectangular frame 1, one at each corner.

The semi-circular tracks are hinged by their front end by the axle 22 in the grooves of the supportive bars 14. The supportive bars 14 are mounted at the angle between the front posts 3 and the longer sides of the rectangular base 1.

The semi-circular tracks 9 are supported by their rear end on the supportive movable bar 4. The supportive bar 4 is mounted on the rear vertical posts 2.

The carriage 11 is located on the semi-circular tracks 9 and can move back and forth with the assistance of four wheels 23. The wheels 23 are equipped with ball bearings.

The semi-circular tracks 9 are equipped with the grooves 20 located either on the top or sides of the tracks 9 in which the wheels 23 of the carriage 11 roll. The grooves 20 are partially covered to prevent the derailment of the carriage 11.

The front vertical posts 3 are extended on the top at an angle forward to serve as supportive means for two footrests or foot supports 5,6. Under the end of these horizontal parts of the posts 3 is mounted a footrest 6 and a few inches apart above these horizontal parts is mounted a footrest 5. The footrest 15 is mounted on the extension of the supportive bars 14 of the front end of the semi-circular tracks 9.

The front firm (collapsible and adjustable) handles 7 are mounted at the top of the vertical portion of the front posts 3 from the back. The rear firm (adjustable) handles 8 with their supportive posts are fitted inside of the top ends of the rear vertical posts 2. They can be adjusted at different heights.

The free handles with their cables 17 and pulleys 16 are mounted on the panel 10 at the top of the semi-circular tracks 9. The pulleys 16 can swivel horizontally. The associated cables 17 are attached to the back end of the carriage 11. The free handles 17 are normally resting on the firm handles 8 of the rear upright posts 2 when not being used. Thus they do not fly around noisily when the carriage 11 is moved on the semi-circular tracks 9 by the person's legs only or by the arms using other handles. In their resting position, the free handles 17 are within easy reach of the person 27.

The "bench press" handles 19 with the pulleys 18 are mounted from the outside on the carriage 11 (about at mid-point distance). Their cables 19 are attached to the rear vertical posts 2 in the vicinity of the supportive bar 4 of the semi-circular tracks 9.

As shown in the drawing a person 27 is supported by the carriage with his feet resting on the footrest. Through the interaction of the legs and/or arms and the upper body, the person 27 slides his, her body with the carriage 11 back and forth, while overcoming or absorbing the gravitational force.

The forward movement of the carriage 11 on the semi-circular tracks 9 is limited by the length of the grooves 20 and by the length of the cables interconnecting the carriage 11, the pulleys 16 and the handles 17 all mounted on the panel 10 on the rear end of the semi-circular tracks 9. Position of the pulleys 16 limits the backward movement of the carriage 11. The pulleys can swivel laterally to permit the exercises in which the arms pull at various angles in a horizontal plane.

Figure 4:
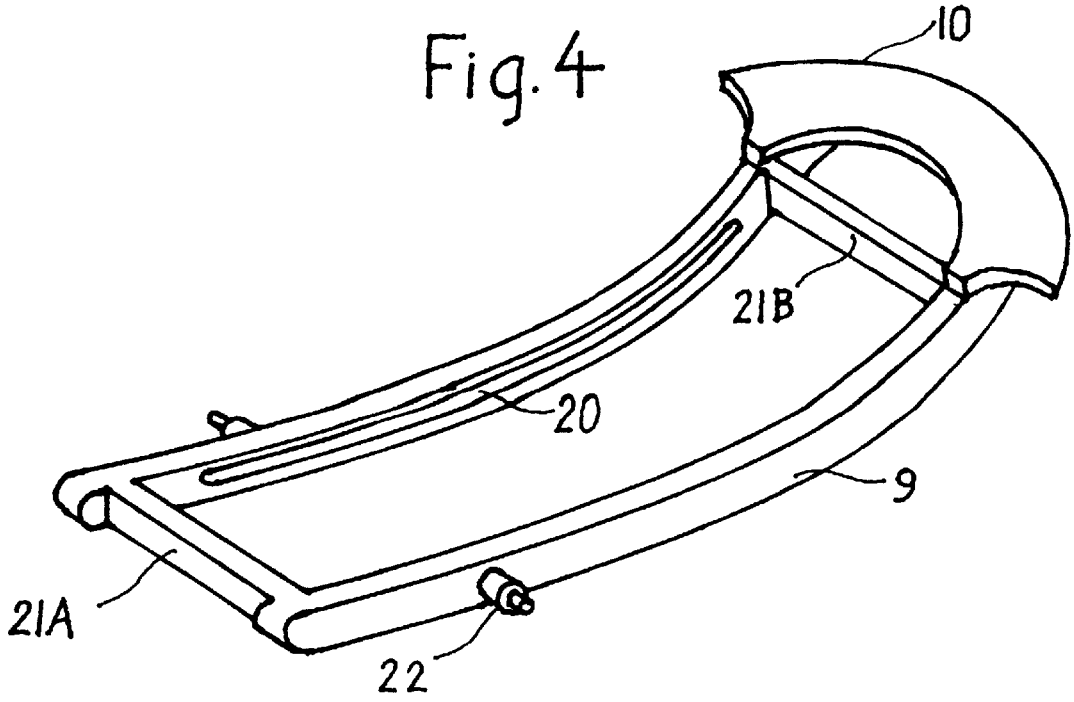
FIG. 4 is a perspective view of the semi-circular tracks.
Figure 5:
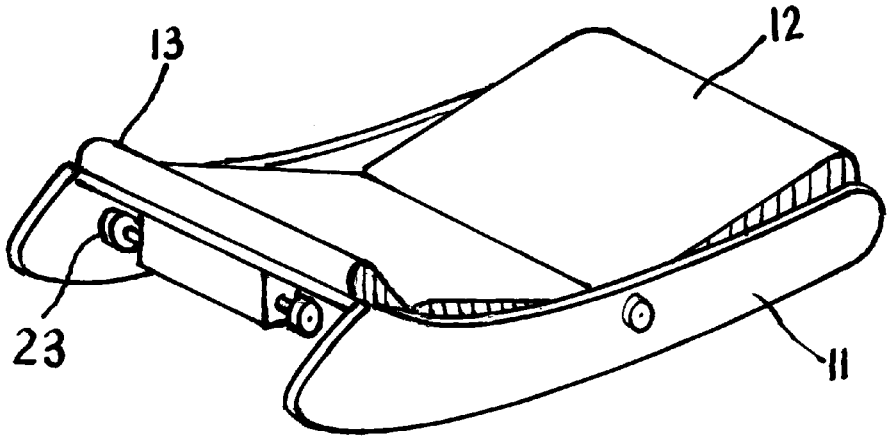
FIG. 5 is a perspective view of the carriage.

The 75 degrees radius (curve) and the 7 foot long semi-circular track 9, the location of various handles and footrests are specifically designed in order to accommodate the necessary range and nature of the body movement in many different exercises. The semi-circular tracks 9 have padded footrests 21A and 21B on their front and rear ends. (FIG. 4) The footrest 21A on the front of the semi-circular tracks 9 is also used for mounting and dismounting the device.

The carriage 11 has a specific rounded shape to correspond to the curved shape of the semi-circular tracks 9. The top padded surface of the carriage 12 is even more curved than the semi-circular tracks 9 in order to allow the trunk and head to generate optimal resistance, friction between the body 27 and the carriage 11 in the first phase of the exercise, when the carriage 11 glides backward and upward being propelled by leg extension or arm flexion. The front short segment of the carriage 13 is free and hinged to the rest of the carriage 11. This bottom segment of the carriage 13 is inclined relative to the rest of the carriage 11 at approximately 40 degree angle in order to force the pelvis of the user to be rotated forward at all times. Consequently, as the head and back press on the carriage 11 as a response reaction to the straightening legs the beneficial strengthening and stretching takes place in the neck, upper back and particularly in the lower back muscles. The muscles of the legs, feet and buttocks are also beneficially exercised. This type of exercise is very important for improving the body posture, preventing and even remedying back pain.

The hinged front segment of the carriage 13 is released and straightened out in exercises executed in other body positions.

The feet can be placed on either of the four footrests which are mounted on the front end of the device, thus providing the legs with different kinds of strengthening exercises such as partial or full extension and flexion of the hips and knees along with plantar and dorsal flexion of the ankles. The user can exercise only the ankles by keeping the knees straight or only partially flexed. All these exercises can be further modified by placing the torso a few inches higher on the carriage 11.

The arms with the hands on the handles 7,8 slide the body with the carriage 11 back and forth either with or without assistance of the legs. The use of the legs can be purposely varied as far as the intensity of involvement is concerned according to the need of the user.

The arms can generate a similar exercise by placing the hands on the rear upright posts 2 or on the front posts 3.

A person 27 can further generate a variety of arm, shoulder and trunk exercises with a large range of arm movement in a frontal and lateral planes by using the "free handles" 17, and "bench press handles" 19.

In order to provide the user 27 during the exercise with valuable information regarding the pressure applied by the feet, the number of repetitions and the time elapsed in the exercise a strain gadget, a counter of repetitions and a timer can be installed on the device. An alarm device can notify the user 27 about the completion of a pre-set number of repetitions and the expiry of pre-set time of duration of the exercise. A heart-rate monitor and heart-rate controls can also be installed on the device. All these gadgets increase the user's 27 interest and motivation necessary for the exercises.

What I claim as my invention is:

1. The exercise device comprising:

a rectangular frame with the front and rear suspension means;

semi-circular tracks with grooves;

a carriage curved lengthwise identically with said semi-circular tracks movably mounted with four wheels on said semi-circular tracks;

said wheels with ball bearings roll in said grooves of said semi-circular tracks, said grooves are partially covered against derailment;

said carriage consists of a solid base and two padded parts on the top, front short and rear curved long part;

said front part is hinged to said rear long part and can be locked in a straight (0 degrees) position or in an inclined position at approximately 40 degrees relative to said rear long curved part;

three different footrests mounted on said front upright suspension means and one mounted on the front end of said semi-circular tracks;

a pair of collapsible and adjustable firm handles mounted to said front upright suspension means;

a pair of adjustable firm handles mounted on said rear upright suspension means;

a pair of handles with cables and pulleys mounted on the rear end of said semi-circular tracks;

a pair of handles with cables and pulleys mounted to the sides of said carriage.

2. The device of claim 1, wherein said carriage is connected by its rear end to said cables, said cables extend along said semi-circular tracks and connect to said pulleys mounted on the rear end of said semi-circular tracks and attach to said handles.

3. The device of claim 1, wherein said pulleys are mounted to the sides of said carriage, said cables originate in the attachment to said rear upright suspension means, extend along said semi-circular tracks and connect to said pulleys and terminate in said handles.

4. The device of claim 1, wherein the front end of said semi-circular tracks is attached to an axle by which said semi-circular tracks is connected to the supportive means; said axle supportive means span at approximately 45 degree angle between said front upright suspension means and the side of said rectangular frame and are equipped on the top with grooves for the location of said axle; the front end of said semi-circular tracks can be lowered by placing said axle in lower positioned said grooves.

5. The device of claim 1, wherein said rear end of said semi-circular tracks rests on its supportive bar mounted between said rear upright suspension means.

6. The device of claim 1, wherein said rear upright suspension means consists of multiple vertically oriented holes a few inches apart; said vertically oriented holes receive the pins, said supportive bar attaches at various levels to said rear upright suspension means;

said supportive bar or the rear end of said semi-circular tracks can be directly mounted to said upright suspension means.

7. The device of claim 1, wherein said semi-circular tracks have a horizontal or inclined position at different angle permitted by said axle and by the position of said supportive bar of said semi-circular tracks.

8. The device of claim 1, wherein said semi-circular tracks is constructed from two round metal bars or from plastic or fiberglass material in a form of a solid semi-circular ramp with two grooves corresponding to the wheels of said carriage.

9. The device according to claim 1 wherein said carriage is equipped with four pairs of rollers or wheels corresponding to the construction of said semi-circular tracks and permitting said carriage to move without derailing on said semi-circular tracks.

* * * * *